United States Patent [19]

Bagalini

[11] Patent Number: 4,931,758

[45] Date of Patent: Jun. 5, 1990

[54] ELECTRO-MAGNETIC SHUNT TRIP DEVICE

[75] Inventor: Dante Bagalini, Johannesburg, South Africa

[73] Assignee: Circuit Breaker Industries Limited, Eland Sfontein, South Africa

[21] Appl. No.: 282,438

[22] Filed: Dec. 9, 1988

[51] Int. Cl.[5] ..... H01H 9/00

[52] U.S. Cl. ..... 335/174; 335/179; 335/184

[58] Field of Search ..... 335/20, 229, 230, 234, 335/172, 173, 174, 177, 178, 179, 182, 184, 78

[56] References Cited

U.S. PATENT DOCUMENTS

| | | | |
|---|---|---|---|
| 3,783,423 | 1/1974 | Mater et al. | 335/174 |
| 4,213,109 | 7/1980 | Marcoz | 335/174 |
| 4,251,789 | 2/1981 | Russell et al. | 335/229 X |
| 4,491,812 | 1/1985 | Happach | 335/184 |
| 4,509,026 | 4/1985 | Matsushita | 335/78 |

*Primary Examiner*—George Harris

*Attorney, Agent, or Firm*—Ladas & Parry

[57] ABSTRACT

An electro-magnetic shunt trip device has a pair of aligned plungers 10,24. A first plunger 19 acts on an operating member 20 which is pivotal and connected to a spring 18. The second plunger 24 is manually displaceable. A further spring 26 is located between the plungers. The plungers are part of a magnetic circuit, with a magnetic field being generated by a permanent magnet 30 and an electro-magnet 32. The permanent magnet and the electro-magnet generate fields of opposite polarity. If there is no current in the electro-magnet, the field provided by the electro-magnet will be sufficiently strong to hold the two plungers together. The spring 18 acting on the operating member will cause it and the plungers to move, so that the operating member is in a non-tripping position. If the second plunger is displaced into contact with the first plunger a tripping circuit in the electro-magnet will allow the spring 26 between the plungers to force them apart, movement of the second plunger being limited, so that the first plunger displaces the operating member.

8 Claims, 1 Drawing Sheet

ELECTRO-MAGNETIC SHUNT TRIP DEVICE

Figure 1:
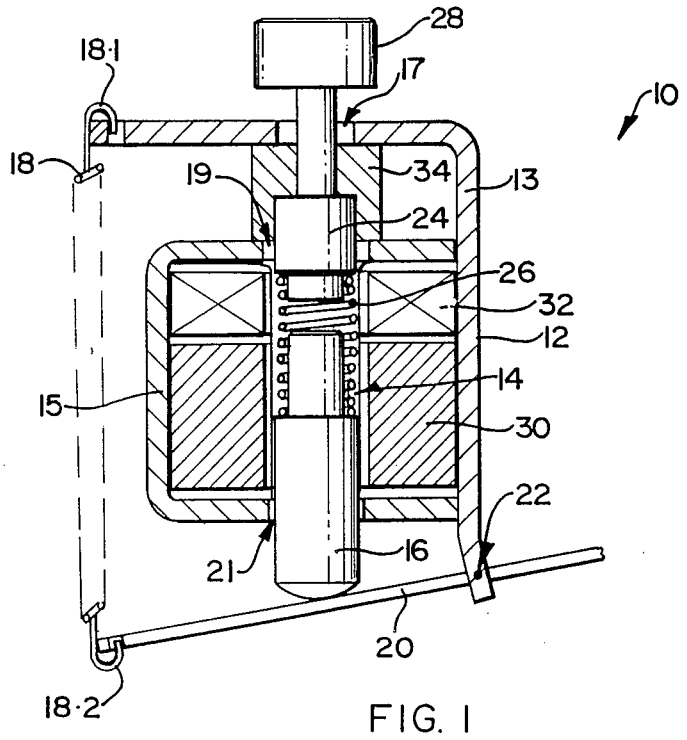

This invention relates to an electro-magnetic shunt trip device. More particularly, it relates to such devices which utilise flux transfer to trip.

According to the invention there is provided an electro-magnetic shunt trip device, which includes a first member that is of a ferro-magnetic material and which is slidably displaceable between a normal position and a tripped position;

a first urging means for urging the first member towards its normal position;

a second member that is also of a ferro-magnetic material and which is slidably displaceable towards and away from the first member, the second member being manually displaceable towards and at least into close proximity to the first member;

a second urging means for urging the first and second member away from one another with movement of the first member away from the second member being towards its tripped position;

a first stop means for limiting movement of the second member away from the first member;

a second stop means for limiting movement of the first member away from the second member;

a magnetic path defining means for defining a magnetic path which passes through both the first and second members;

a first magnetic field generating means for generating a magnetic field in the magnetic path; and an electrically operable second magnetic field generating means for generating a magnetic field which is of reverse polarity to the field generated by the first magnetic field generating means, with the first and second magnetic field generating means being operable such that in use, the magnetic field generated by only the first magnetic field generating means is sufficiently strong to hold the first and second members together when the second member is displaced into contact with, or into sufficiently close proximity with, the first member, against the forces exerted on the first and second members by the second urging means, and the net magnetic field resulting from the first and second magnetic fields is not sufficiently strong to hold the first and second members together.

It will be appreciated, that when sufficient current passes through the second magnetic field generating means, to generate a reverse magnetic field which decreases the magnetic force holding the first and second members together to a sufficient extent, the second urging means will force the first and second members apart, and when the second member engages the stop means, the first member is then displaced, against the force exerted thereon by the first urging means, into its tripped position. It will thus be appreciated that the second urging means exerts a greater force on the first member, when the first and second members are not held together magnetically, than the force exerted on the first member by the first urging means. Further, in order to reset the device, the second member is manually displaced towards the first member with the first member moving away, with a separation between the two members and when the first member reaches its limit as set by the second stop means, the separation between the first and second member will decrease and they will come into contact, or sufficiently close together, for the magnetic forces to hold them together.

The device may include a movable operating member which engages the first member. The first urging means may then act on this operating member which in turn acts on the first member. Movement of the operating member may be limited, so that when it reaches its limit, further movement of the first member is also limited.

The first magnetic field generating means may be a primary magnet or an electro-magnet.

In a preferred form, the first and second members are aligned and are linearly displaceable.

Figure 2:
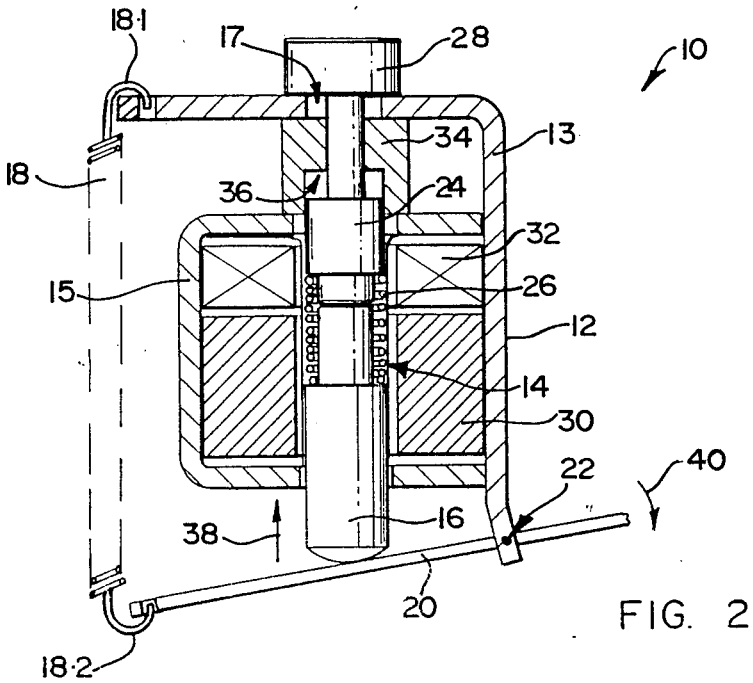

The invention is now described, by way of an example, with reference to the accompanying drawings, in which FIG. 1 shows a sectioned view of a trip device in accordance with the invention, showing the device in its tripped condition; and FIG. 2 shows how the device is re-set and still maintains its tripped condition.

Referring to the drawings, an electro-magnetic shunt trip device is designated generally by the reference numeral 10. The device 10 comprises a frame 12 formed by a body member 13 and a yoke 15. The body member 13 has an aperture 17 and the yoke has apertures 19 and 21 which are aligned with one another and the aperture 17. The aligned apertures define a passageway 14 within which a first member, in the form of a plunger 16 of a ferro-magnetic material is slidably displaceable between a normal position and a tripped position.

The device 10 includes a first urging means in the form of a tension spring 18 for urging the first member towards its normal position. The spring 18 has a first end 18.1 secured to the frame 12, and a second end 18.2 secured to an operating member in the form of an arm 20, the arm 20 being in abutment with the plunger 16. Further, the operating member is pivotally mounted on the frame 12 and pivots about a pivot point 22. Pivoting of the operating member away from the plunger 16 is limited by a response component such as a switch (not shown).

The device 10 further includes a second member in the form of a plunger 24 which is also of a ferro-magnetic material, and which is displaceable towards and away from the first plunger 16. As shown, the plungers 16 and 24 are aligned, and are linearly displaceable with respect to each other. The plunger 24 is displaceable relative to the plunger 16 against the action of an urging means in the form of a compression spring 26. A reset button 28 of a synthetic plastics material is secured to the plunger 24 and projects beyond the frame 12 to be engageable by an operator of the device 10.

A first magnetic field generating means in the form of a permanent magnet 30 is mounted in the yoke 15 and is in the form of two bar magnets, one on one side and one on the other side of the passageway 14 in which the plunger 16 is slidably displaceable.

An electrically operable second magnetic field generating means in the form of an electro-magnet 32 also is mounted in the yoke 15. This electro-magnet 32 is in the form of a bobbin with a coil wound thereon. The bobbin has a central bore that is aligned with the passage way 14, so that the plunger 24 moves therein. The plunger 24 is thus displaceable through the central bore of the electro-magnet 32.

A boss 34 is mounted on the frame 12. The boss 34 defines a stop means in the form of a shoulder formation 36 for limiting displacement of the plunger 24 in a direction away from the plunger 16.

The magnetic field generated by the electro-magnet 32 is of a polarity opposite to that of the magnetic field generated by the permanent magnet 30.

In use, the second plunger 24 is urged towards the first plunger 16 from the position shown in FIG. 1 to the position shown in FIG. 2 in which the plungers 16 and 24 are in contact. The magnetic field generated by the permanent magnet 30 produces lines of flux which reclose through mating faces of the plungers 16 and 24. This produces an attractive force which is greater that the repelling force provided by the spring 26, thereby retaining the device 10 in its reset position. As stated above, the electro-magnet 32 produces a magnetic field of a polarity opposite to that of the field generated by the magnet 30. However, should the attractive force produced by the permanent magnet exceed that of the repelling force produced by the compression spring 26 and the electro-magnet 32, the plungers 28 and 16 will move in the direction of arrow 38 under the action of the spring 18, thereby causing the operating member to pivot about the pivot point 22 in the direction of the arrow 40.

When sufficient current passes through the electro-magnet 32 to generate a reverse magnetic field which decreases the attractive force holding the plungers 16 and 24 together to a sufficient extent, the spring 26 forces the plungers 16 and 24 apart, and when the plunger 24 engages the shoulder 36, the plunger 16 is displaced from the plunger 24 under the action of the spring 26 into its tripped position. This will cause the operating member 20 to pivot about the pivot point 22 in a direction opposite to that indicated by arrow 40. Hence, it will be appreciated that the spring 26 exerts a greater force on the plunger 16 when the plungers 16 and 24 are not magnetically held together than the force exerted on the plunger 16 by the spring 18.

Movement of the operating member 20 is limited by a response switch or the like (not shown), so that when the plunger 24 is manually displaced to reset the device 10, the and the spring 26 is compressed.

A device 10 in accordance with the invention can accordingly be used to unlatch a circuit breaker, to activate or deactivate a micro-switch, or to operate an indicating flag. Further, it will be appreciated that when there is sufficient current passing through the electro-magnet 32 to cause the plungers 24 and 16 to be repelled, holding the reset button 28 so that the plunger 24 is in abutting engagement with the plunger 16 will not prevent the releasing of the shunt trip.

I claim:

1. An electro-magnetic shunt trip device, which includes a first member that is of ferro-magnetic material and which is slidably displaceable between a normal position and a tripped position;

a first urging means for urging the first member towards its normal position;

a second member that is also of a ferro-magnetic material and which is slidably displaceable towards and away from the first member, the second member being manually displaceable towards and at least into close proximity to the first member;

a second urging means for urging the first and second member away from one another with movement of the first member away from the second member being towards its tripped position;

a first stop means for limiting movement of the second member away from the first member;

a second stop means for limiting movement of the first member away from the second member;

a magnetic path defining means for defining a magnetic path which passes through both the first and second members;

a first magnetic field generating means for generating a magnetic field in the magnetic path; and an electrically operable second magnetic field generating means for generating a magnetic field which is of reverse polarity to the field generated by the first magnetic field generating means, with the first and second magnetic field generating means being operable such that in use, the magnetic field generated by only the first magnetic field generating means is sufficiently strong to hold the first and second members together when the second member is displaced into at least sufficiently close proximity with the first member, against the forces exerted on the first and second members by the second urging means, and the net magnetic field resulting from the first and second magnetic fields is not sufficiently strong to hold the first and second members together.

2. An electro-magnetic shunt trip device as claimed in claim 1, in which the second urging means and the first urging means exert opposed forces on the first member and the second urging means exerts a greater force on the first member than the first urging means.

3. An electro-magnetic shunt trip device as claimed in claim 1, which includes a movable operating member which contacts the first member to be displaceable by it.

4. An electro-magnetic shunt trip device as claimed in claim 3, in which the first urging means acts on the operating member which in turn acts on the first member.

5. An electro-magnetic shunt trip device as claimed in claim 3, in which movement of the operating member is limited, such that the second stop means includes the operating member.

6. An electro-magnetic shunt trip device as claimed in claim 1, in which the first magnetic field generating means is a permanent magnet.

7. An electro-magnetic shunt trip device as claimed in claim 1 in which the first and second members are linearly displaceable and aligned.

8. An electro-magnetic shunt trip device as claimed in claim 1 wherein the magnetic field generated by only said first magnetic field generating means is sufficiently strong to hold said first and second members together when said second member is displaced into contact with said first member.

* * * * *